United States Patent [19]

Glibbery

[11] Patent Number: 4,529,229

[45] Date of Patent: Jul. 16, 1985

[54] LABELS

[75] Inventor: Alan E. Glibbery, Benfleet, England

[73] Assignee: Labeltech Limited, England

[21] Appl. No.: 477,252

[22] Filed: Mar. 21, 1983

[30] Foreign Application Priority Data

Apr. 2, 1982 [GB] United Kingdom ..... 8209902
Aug. 30, 1982 [EP] European Pat. Off. ..... 82107946

[51] Int. Cl.[3] ..... B42D 15/00
[52] U.S. Cl. ..... 283/81; 283/75
[58] Field of Search ..... 283/81, 6; 156/DIG. 29; D33/9 R; D20/22; 281/6

[56] References Cited

U.S. PATENT DOCUMENTS

| | | | |
|---|---|---|---|
| 1,896,834 | 2/1933 | Brown | 283/81 |
| 2,706,865 | 4/1955 | Miller | 283/81 |
| 2,975,091 | 3/1961 | Tobey | 283/81 |
| 3,740,081 | 6/1973 | Whipperman | 283/81 |
| 4,103,821 | 8/1978 | Gartshore | 283/81 |
| 4,128,954 | 12/1978 | White | 283/81 |

FOREIGN PATENT DOCUMENTS

| | | | |
|---|---|---|---|
| 0043179 | 1/1982 | European Pat. Off. . | |
| 2402264 | 10/1977 | France | 283/81 |
| 1398912 | 6/1975 | United Kingdom . | |

*Primary Examiner*—Paul A. Bell
*Assistant Examiner*—Paul M. Heyrana, Sr.
*Attorney, Agent, or Firm*—Fulwider, Patton, Rieber, Lee & Utecht

[57] ABSTRACT

A label comprises a paper band having a plurality of panels connected end to end along respective fold lines extending widthwise of the band. A first such panel, intermediate the ends of the band in the preferred embodiment, is connected along a first fold line with a second panel at one end of the band, and is connected along a second fold line with a third panel, to which further panels are likewise connected. The first panel has stuck to one face thereof an adhesive strip. The remainder of the band, connected with the first panel at the second fold line, is folded in zig-zag fashion about its fold lines and is folded onto the first panel to overlie the face thereof remote from the adhesive strip. The second panel is, in turn, folded about the first fold line to overlie the folded remainder of the band and is stuck to the third panel via a detachable and re-sealable adhesive strip.

7 Claims, 4 Drawing Figures

LABELS

FIELD OF THE INVENTION

This invention relates to labels, for example labels for containers for horticultural or photographic chemicals in respect of which there is a need, not only for an identification of the contents of the containers, but also for somewhat detailed instructions for use or the like.

In the past, various kinds of folded labels, tear-off information sheets and the like have been proposed to meet this need, as well as the simple expedient of attaching a separately formed sheet of instructions to a container, for example by an encircling rubber band or the like. However, these prior proposals have had the disadvantage of requiring excessive manual labour, or of making it difficult, once the leaflet or the like containing the instructions has been consulted, to keep the instructions thereafter conveniently with the container for future reference.

SUMMARY OF THE INVENTION

It is an object of the present invention to provide an improved label by which the above-noted disadvantages may be avoided.

According to the invention there is provided a label comprising a band of sheet material, the band comprising a plurality of panels connected end to end along respective fold lines extending widthwise of the band, said panels including a first panel coated on one face with an adhesive whereby said first panel may be stuck to an object, a second panel connected via a first fold line and one end of the first panel and folded over on the first panel, said second panel being connected along its edge remote from said first fold line with a part of the label other than said second panel.

Preferably said band includes a third panel connected via a second fold line with the end of the first panel opposite said first fold line, the panels being so disposed that the third panel overlies the first panel on the face thereof remote from said adhesive and said second panel overlies said third panel on the face of said third panel remote from said first panel, said second panel being connected along its edge remote from said first fold line with a part of the label other than said second panel.

DESCRIPTION OF PREFERRED EMBODIMENTS

Figure 1:
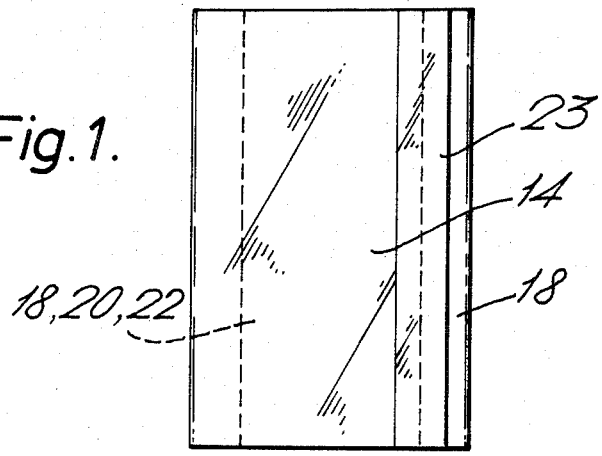
FIG. 1 is a plan view of a label embodying the invention in a folded condition.

Referring to the drawings, a label comprises an elongate rectangular band of paper divided, by transversely extending fold lines, into a plurality of panels. Thus, the band comprises a first panel 10 connected via a first fold line 12 with a second panel 14 affording one end of the strip, the panel 10 being connected, via a second fold line 16, with a section of the band which affords the other end of the band and which, in the example shown, comprises a third panel 18, connected with the panel 10 via the fold line 16, a panel 20 connected with the panel 18 via a fold line 19 and a panel 22 connected with the panel 20 via a fold line 21.

Figure 3:
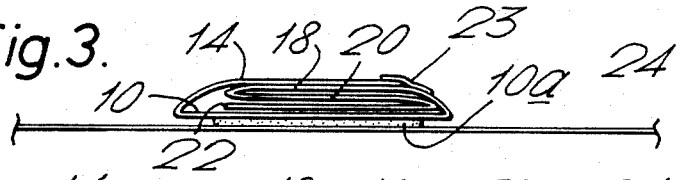
FIG. 3 is a schematic end elevation view of the label of FIGS. 1 and 2 attached to a release sheet.

In the folded condition of the label, the panel 20 is folded about fold line 19 onto the panel 18, the panel 22 is folded about fold line 21 onto the panel 20, and the panel 18, with the panels 20 and 22 folded against it, is folded over onto the panel 10, so that the panels 20 and 22 lie between the panel 18 and the panel 10. The panel 14 is then folded about the fold line 12 onto the panel 18, as shown in FIG. 3, so that the panels 18, 20 and 22 are disposed between the panels 10 and the panel 14. The panel 14 is then secured adjacent its free edge, to the portion of the panel 18 which adjoins the fold line 16, for example by means of an adhesive strip 23 superimposed on the panels 14 and 18 to overlap the free edge of the panel 14, the strip 23 having, on its side engaging the panels 14 and 18, a coating of permanently tacky, pressure-sensitive adhesive.

The panels 14, 18, 20 and 22, and the portion of panel 10 which faces towards the panels 18, 20 and 22 in the folded condition of the label conveniently comprise respective parts of a single strip of paper, while the face of the panel 10 which faces away from the panels 18, 20 and 22 in the folded condition of the label is afforded by a separately formed support piece of paper, 10*a*, (see FIG. 3), which is permanently stuck to the strip of paper providing the panels 14,, 18, 20 and 22. The piece of paper 10*a* carries, on its face facing away from said strip of paper, a coating of a pressure sensitive, permanently tacky adhesive by means of which, in use, the label is applied to a container or the like. Each piece of paper 10*a* may thus have the form which is already known for self-adhesive labels per se.

Whilst it would be possible to dispense with the separate piece of paper 10*a* and apply the adhesive directly to the portion of the strip of paper forming the panel 10, it is, in fact, much easier to provide, in known manner, a series of pieces of paper 10*a*, coated with said adhesive and temporarily supported, on their adhesive coated sides, by a strip of release paper, and to paste the already folded and retained (by strips 24) paper strips to the pieces 10*a*, for example by passing said strip of release paper, with the pieces 10*a* thereon, longitudinally through a machine or pasting station which applies paste to the pieces 10*a* in succession, whilst they are supported on the release strip, and then applies the folded strips affording panels 14, 18 etc. to the pasted pieces 10*a* in succession. Alternatively, of course, such a machine may apply past to the folded strips prior to affixing the folded strips to their respective pieces 10*a* in succession as the release strip passes through the machine. In the same way, it would be possible to apply a band of pressure sensitive adhesive directly to the panel 14 in the region of its free edge and to dispense with the strip 23, but the forming and folding of the paper strip is much facilitated if a separate securing strip 23 is used.

Figure 2:
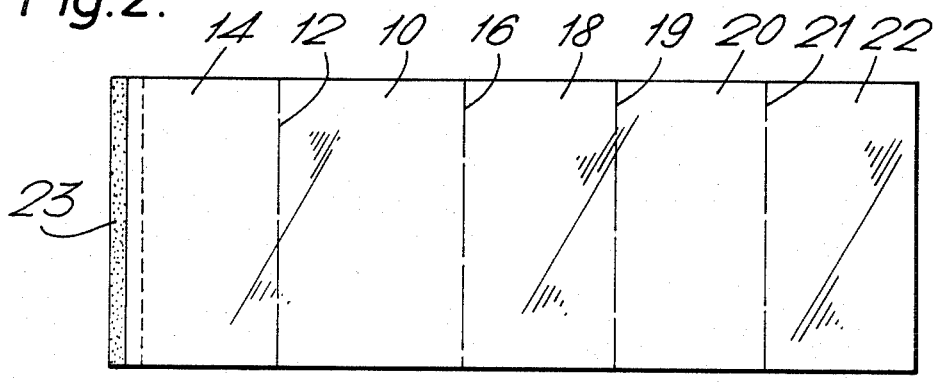
FIG. 2 is a plan view of the label in an unfolded condition.
Figure 4:
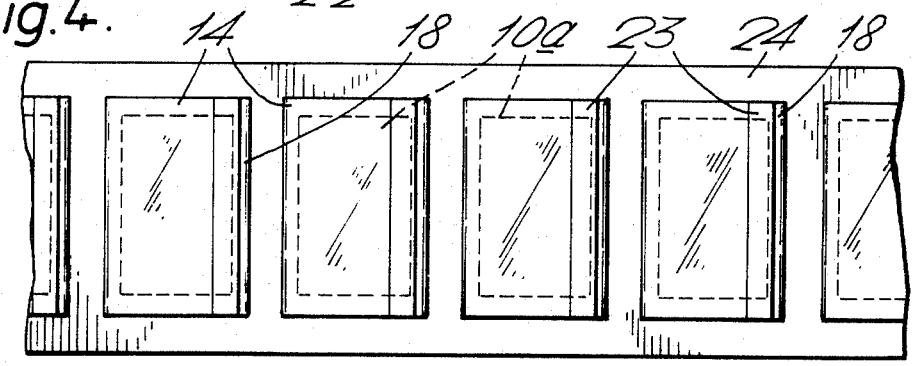
FIG. 4 illustrates a strip of release paper with a plurality of labels such as shown in FIGS. 1 to 3 attached thereto, for supply to an automatic labelling machine.

FIG. 4 shows a series of similar labels such as shown in FIG. 1 to 3 secured to a strip of release paper 24. In use, the strip 24, for example wound into a roll, is supported in a labelling machine and is fed longitudinally into the machine which operates to apply the labels one after the other to successive containers or the like to be labelled.

In manufacture of the labels, the paper strips which afford the panels 14, 18, 20 and 22 and the upper portion of the panel 10 are appropriately printed, then folded and secured by their strips 23, then adhesively secured for the pieces 10*a* already supported on their release strip 24. The face of the panel 14 which is presented outwardly in the folded condition of the label as viewed in FIG. 1 is printed, for example, with material identifying the contents of a container to which the label is to be applied, whereas the outer face of the panel 10 and either or both faces of the panels 18, 20 and 22 are printed with, for example, instructions for use of the product in the container or the like.

The purchaser of the container or the like having the label applied thereto, when he wishes to consult the instructions embodied in the label, simply peels off the strip 23 and unfolds the panels 18, 20 and 22 and to consult the instructions. He may thereafter re-fold the strip to its original condition and re-apply the strip 23 so that the instructions are still retained in the label, with the container, as a neat package.

If desired, the strip 23 may be omitted and the free edge of the panel 14 permanently stuck to the opposing surface of the panel 18, with a tear line being provided on the panel 14, parallel with the fold lines, at a position intermediate the permanent adhesive connection with the panel 18 and the fold line 12. The tear line may simply be a line printed to indicate where the panel 14 should be torn to gain access to the instructions, or may be a line of perforation or other line of weakening to assist in such tearing. In this arrangement after the panel 14 has been torn to allow the strip to be viewed, the re-folded strip may be retained in a folded condition by tucking under the remainder of panel 14 still attached to panel 18. If desired, a tear line, for example a line of perforations, may be provided at the junction of the panel 18 with the panel 10 to allow the instructions or the like printed on panels 18 to 22 to be torn off, or such a tear line may be provided between any of the panels 18 to 22 and the adjoining panel to allow the respective portion of the label to be torn off.

It will be appreciated that sundry variants of the label disclosed with reference to the drawings are possible. For example, the panels 20 and 22 may be omitted, if the surface of panels 10 and 18 and the reverse surface of panel 14 are sufficient for the instructions or the like. Indeed, the panel 18 may be omitted, and the panel 14, when folded over, simply affixed by the strip 23 to the outwardly presented face of the panel 10.

I claim

1. A label comprising a band of sheet material, the band having respective fold lines, extending widthwise of the band, and formed by folding the band transversely, the band comprising a plurality of panels defined between said fold lines whereby the panels are connected end to end along respective said fold lines extending widthwise of the band, said panels including a first panel, a second panel connected via a first of said fold lines with one end of the first panel, and means connecting said second panel, along its edge remote from said first fold line, with a part of the band of sheet material other than said second panel, said means connecting said second panel along its edge remote from said first fold line with said part of the band of sheet material, including a permanently tacky contact adhesive whereby the second panel can be temporarily detached from, and subsequently reaffixed to, said part of the band other than said second panel, the label further comprising a base sheet having a layer of permanently tacky contact adhesive on one face of said base sheet and an adhesive for affixing said first panel to said base sheet on the other face of said base sheet.

2. The label of claim 1, wherein said band includes a third panel connected via a second said fold line with the end of the first panel opposite said first fold line, the panels being so disposed that the third panel overlies the first panel on the face thereof remote from said base sheet and said second panel overlies said third panel on the face of said third panel remote from said first panel, and wherein said means connecting said second panel with said part of the band of sheet material other than said second panel comprises means connecting said second panel, along its edge remotefrom said first fold line, with said third panel.

3. The label of claim 2 wherein said band has an end section comprising a plurality of said panels, connected end to end along respective said fold lines extending widthwise of the band, said end section of the band including said third panel whereby said end section is connected with said first panel along said second fold line, the panels of said end section being folded together about their respective fold lines so as to form a flat bundle accommodated between said first and second fold lines.

4. The label of claim 1, wherein said means connecting said second panel with said part of the band other than said second panel comprises a removable self-adhesive strip, and a permanently tacky contact adhesive on said strip, whereby said self-adhesive strip, after removal from the remainder of the label to allow said second panel to be separated from said part of the band other than said second panel, can subsequently be reapplied to re-secure said second panel to said part of the band other than said second panel.

5. A label comprising a band of sheet material, the band having respective fold lines extending widthwise of the band and formed by folding the band transversely, the band comprising a plurality of panels defined between said fold lines whereby the panels are connected end to end along respective said fold lines extending widthwise of the band, said panels including a first panel, a second panel connected via a first of said fold lines with one end of the first panel, and means connecting said second panel, along its edge remote from said first fold line, with a part of the band of sheet material other than said second panel, said means connecting said second panel along its edge remote from said first fold line with said part of the band of sheet material, including a removable self-adhesive strip, and a permanently tacky contact adhesive on said strip, whereby the second panel can be temporarily detached from, and subsequently reaffixed to, said part of the band other than said second panel, the label further comprising a base sheet having a layer of permanently tacky contact adhesive on one face of said base sheet and an adhesive for affixing said first panel to said base sheet on the other face of said base sheet.

6. The label of claim 5, wherein said band includes a third panel connected via a second said fold line with the end of the first panel opposite said first fold line, the panels being so disposed that the third panel overlies the first panel on the face thereof remote from said base sheet and said second panel overlies said third panel on the face of said third panel remote from said first panel, and wherein said means connecting said second panel with said part of the band of sheet material other than said second panel comprises means connecting said second panel, along its edge remote from said first fold line, with said third panel.

7. The label of claim 6, wherein said band has an end section comprising a plurality of said panels, connected end to end along respective said fold lines extending widthwise of the band, said end section of the band including said third panel whereby said end section is connected with said first panel along said second fold line, the panels of said end section being folded together about their respective fold lines so as to form a flat bundle accommodated between said first and second fold lines.

* * * * *